US008454121B2

(12) United States Patent
Yamamoto et al.

(10) Patent No.: US 8,454,121 B2
(45) Date of Patent: Jun. 4, 2013

(54) LIQUID EJECTING APPARATUS

(75) Inventors: Taisuke Yamamoto, Matsumoto (JP); Kentaro Tatsumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 488 days.

(21) Appl. No.: 12/190,793

(22) Filed: Aug. 13, 2008

(65) Prior Publication Data

US 2009/0201336 A1 Aug. 13, 2009

(30) Foreign Application Priority Data

Aug. 20, 2007 (JP) ..... 2007-213762

(51) Int. Cl.
*B41J 2/185* (2006.01)
*B41J 2/165* (2006.01)

(52) U.S. Cl.
USPC ..... 347/36; 347/31

(58) Field of Classification Search
USPC ..... 347/30, 31
See application file for complete search history.

(56) References Cited

U.S. PATENT DOCUMENTS 6,565,186 B1 * 5/2003 Hattori et al. ..... 347/24

FOREIGN PATENT DOCUMENTS

| | | |
|---|---|---|
| JP | 2001-171148 A | 6/2001 |
| JP | 2004-074640 | 3/2004 |
| JP | 2004-142207 | 6/2004 |
| JP | 2005-329693 | 12/2005 |
| JP | 2006-192679 | 7/2006 |
| JP | 2007-190855 | 6/2007 |
| JP | 2007-223303 | 9/2007 |
| JP | 2007-253526 | 10/2007 |

* cited by examiner

*Primary Examiner* — Kevin S Wood
(74) *Attorney, Agent, or Firm* — Workman Nydegger

(57) ABSTRACT

A liquid ejecting apparatus including a liquid ejecting head which ejects liquid through nozzles, a liquid container with a sloped bottom surface which receives the liquid ejected from the nozzles, an absorber disposed in the liquid container which absorbs and stores the liquid ejected from the nozzles, and a suction unit which sucks the liquid held by the absorber and discharges the liquid from the liquid container. The liquid container includes a restriction portion which restricts the flow of the liquid in the absorber due to gravity, forming collection portions in the absorber where the liquid may be collected at a plurality of positions with different elevations when the liquid container is rotated so that the bottom surface is sloped away from the horizontal plane.

9 Claims, 11 Drawing Sheets

LIQUID EJECTING APPARATUS

The entire disclosure of Japanese Patent Application No. 2007-213762, filed Aug. 20, 2007 is expressly incorporated herein by reference.

BACKGROUND

1. Technical Field

The present invention relates to a liquid ejecting apparatus such as an ink jet printer.

2. Related Art

One type of liquid ejecting apparatus is an ink jet printer, hereinafter referred to as a printer, which includes a recording head, comprising a liquid ejecting head, which is capable of ejecting ink or other liquid supplied from an ink cartridge onto a recording medium through nozzles provided in the recording head in order to perform a printing process.

In such a printer, when printing is suspended, ink is thickened by the volatilization of the ink solvent in the ink existing in the nozzles. In some instances, this causes the nozzles to become clogged, and printing failures, such as dot omissions, may occur. In order to solve this problem, a flushing operation may be performed, wherein the ink is ejected as a waste ink from the nozzles of the recording head into a flushing box (liquid container). The ink ejected into the flushing box is absorbed to an absorber contained in the flushing box and is stored in the absorber.

In some printers, there is a function for using a suction pump or suction unit to apply a suction force on the ink stored in the flushing box in order to move the ink outside the flushing box. In such printers, compared with the printers which does not include the configuration for removing the ink in the flushing box, the ink holding force of the absorber is held over a long time while the ink solvent is suppressed from being volatilized between ink removal processes, so that thickened ink may be prevented from becoming deposited in the flushing box (for example, see JP-A-2005-329693).

However, recently, a printer has been created with a recording head which is sloped by a predetermined angle (for example, see JP-A-2006-192679). In this printer, in correspondence with the arrangement of the recording head, a flushing box is provided such that an inner bottom thereof is sloped with a corresponding predetermined angle. Accordingly, the ink ejected into the flushing box by performing flushing is not equally distributed in the absorber and gravitates toward the lower side of the absorber. That is, since the ink cannot be held in the overall absorber, the ink holding capability of the absorber deteriorates compared with the case where the ink can be equally dispersed in the absorber. Accordingly, when the suction pump is driven before the lower side of the absorber is completely saturated by the ink, the ink removal process is deficient. This means that the number of times of driving of the suction pump is increased and a load applied to the suction pump is increased compared with the case where the ink is equally distributed in the absorber.

BRIEF SUMMARY OF THE INVENTION

An advantage of some aspects of the invention is that it provides a liquid ejecting apparatus which is capable of efficiently bringing out liquid holding capability of an absorber provided in a liquid container of which an inner bottom is sloped with respect to a horizontal plane so as to reduce a load applied to a suction unit.

According one aspect of the invention is a liquid ejecting apparatus comprising a liquid ejecting head capable of ejecting liquid through a plurality of nozzles, a liquid container, the liquid container being capable of receiving the liquid ejected as a waste material from the plurality of nozzles of the liquid ejecting head, an absorber disposed in the bottom of the liquid container which is capable of absorbing and storing the waste material, and a suction unit capable of sucking the waste material held by the absorber and discharging the waste material from the liquid container. The liquid container comprises a restriction portion capable of restricting the flow of the waste material to a portion of the absorber with a lower elevation, and the absorber comprises collection portions at a plurality of positions with different elevations where the waste material may be collected when the liquid container is rotated so that the bottom surface is sloped away from the horizontal plane.

According to the invention, when the liquid container is disposed such that the inner bottom is sloped with respect to the horizontal plane, the collection portions are formed at the plurality of positions with different elevations. Accordingly, it is possible to efficiently store the liquid in the absorber compared with the case where only one collection portion is formed in the absorber. Accordingly, it is possible to reduce the number of times the suction unit is driven to discharge the liquid held in the absorber from the liquid container. Therefore, it is possible to reduce a load applied to the suction unit by efficiently bringing out the liquid holding capability of the absorber provided in the liquid container which is disposed when the inner bottom is sloped with respect to the horizontal plane.

BRIEF DESCRIPTION OF THE DRAWINGS

The invention will be described with reference to the accompanying drawings, wherein like numbers reference like elements.

FIGS. 9A and 9B are schematic views showing the main portions of the maintenance unit, wherein FIG. 9A is a schematic view showing the case where a wiper member for a single column is positioned at a wiping position and FIG. 9B is a schematic view showing the case where a flushing box is positioned at a reception position.

DESCRIPTION OF EXEMPLARY EMBODIMENTS

First Embodiment

Hereinafter, a first embodiment of the present invention will be described with reference to FIGS. 1 to 11. In the following description, the front and back directions, left and right directions, and upper and lower directions correspond to the directions denoted by arrows of FIG. 1. Furthermore, the left and right directions correspond to the main scanning direction, and the front and back directions correspond to the sub-scanning direction.

Figure 1:
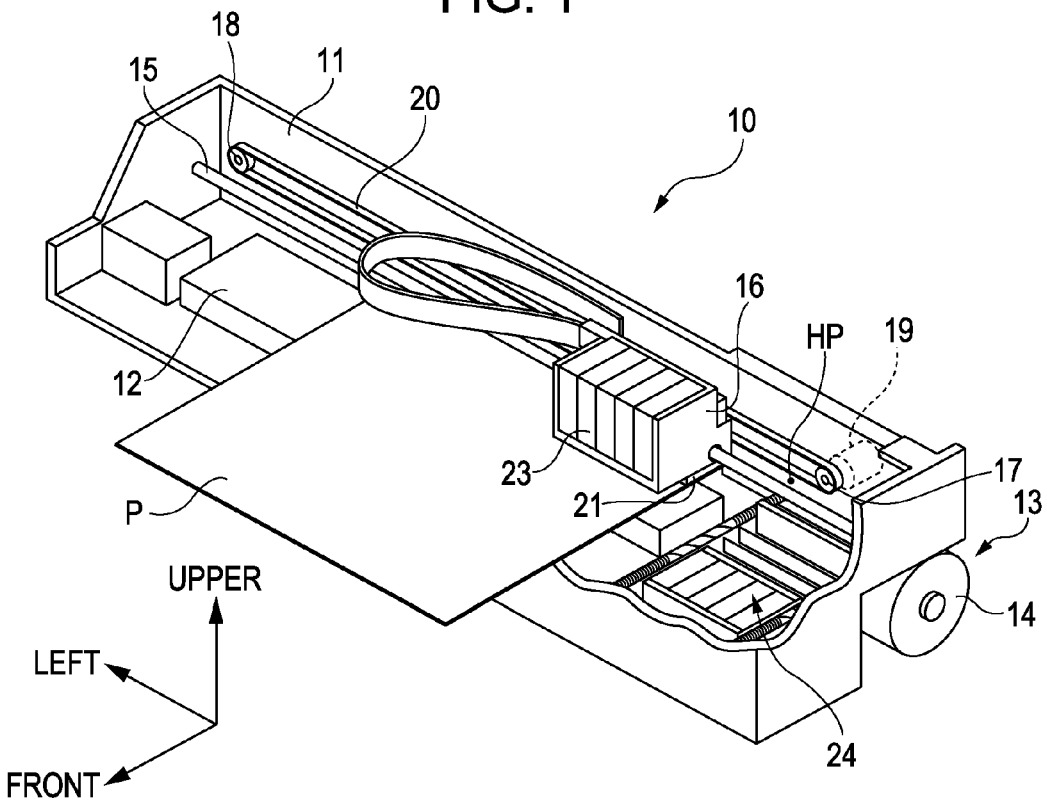
FIG. 1 is a perspective view of a printer of a first embodiment of the invention.

As shown in FIG. 1, a printer 10 is used to illustrate an example of a liquid ejecting apparatus capable of being used in association with the invention. The printer 10 includes a main casing 11 having a rectangular shape. A platen 12 is installed at the lower side of the main casing 11 in the left and right direction along the longitudinal direction of the main casing, and a waste ink tank (not shown) is provided below the platen 12. The platen 12 is a support for supporting a sheet P, which is fed in a sub scan direction through the printer in response to the driving force of a sheet transporting motor 14 included in a sheet transporting mechanism 13.

A guide shaft 15 is installed above the platen 12 in the main casing 11. In the guide shaft 15, a carriage 16 is movably supported. At both ends of the guide shaft 15 in the main casing 11, a driving pulley 17 and a driven pulley 18 are rotatably supported. A carriage motor 19 which is a driving source for reciprocally moving the carriage 16 is connected to the driving pulley 17, and a timing belt 20 for fixing and supporting the carriage 16 is stretched over a pair of pulleys 17 and 18. Accordingly, the carriage 16 is moved in the main scanning direction along the guide shaft 15 by the timing belt 20 which is driven by the carriage motor 19.

Figure 2:
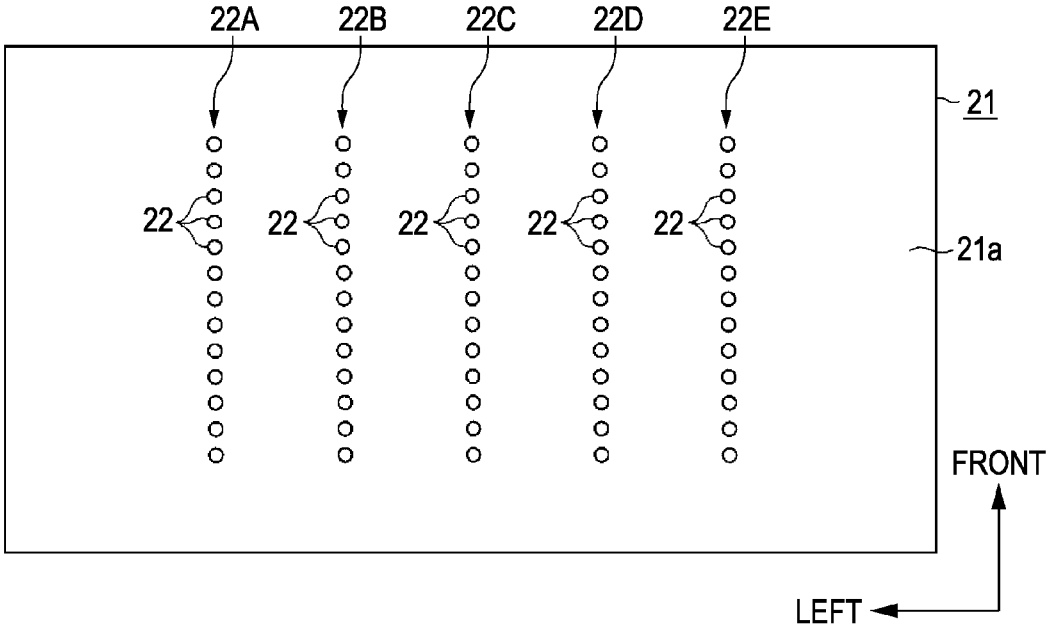
FIG. 2 is a bottom view of a recording head.

On a lower surface of the carriage 16, a recording head 21 is provided, which acts as a liquid ejecting head. As shown in FIG. 2, a nozzle forming surface 21*a* is formed on the lower surface of the recording head 21, where a plurality of nozzles 22 are formed at predetermined intervals in the left and right directions, so as to form a plurality (five are shown in FIG. 2) of nozzle arrays 22A, 22B, 22C, 22D and 22E in the front and back directions. Opening portions of the nozzle forming surface 21*a* in the nozzles 22 are called nozzle openings.

Meanwhile, as shown in FIG. 1, a plurality of ink cartridges 23 (five in the present embodiment) for supplying inks to the recording head 21 are detachably mounted on the carriage 16. The ink cartridges 23 respectively correspond to the nozzle arrays 22A to 22E formed in the nozzle forming surface 21*a* of the recording head 21 and the inks are supplied into the nozzles 22 of the nozzle arrays 22A to 22E via ink channels (not shown) formed in the recording head 21.

A home position HP where the carriage 16 is positioned when the power of the printer 10 is turned off or when a maintenance operation is being performed on the nozzle forming surface 21*a* of the recording head 21 is provided at a right end of the main casing 11, that is, at a non-printing area away from the path of the sheet P. A maintenance unit 24 for performing various types of maintenance operations for ensuring that the ink ejection from the recording head 21 to the sheet P is properly maintained is provided below the home position HP.

Next, the configuration of the maintenance unit 24 will be described with reference to FIGS. 3 to 10.

Figure 3:
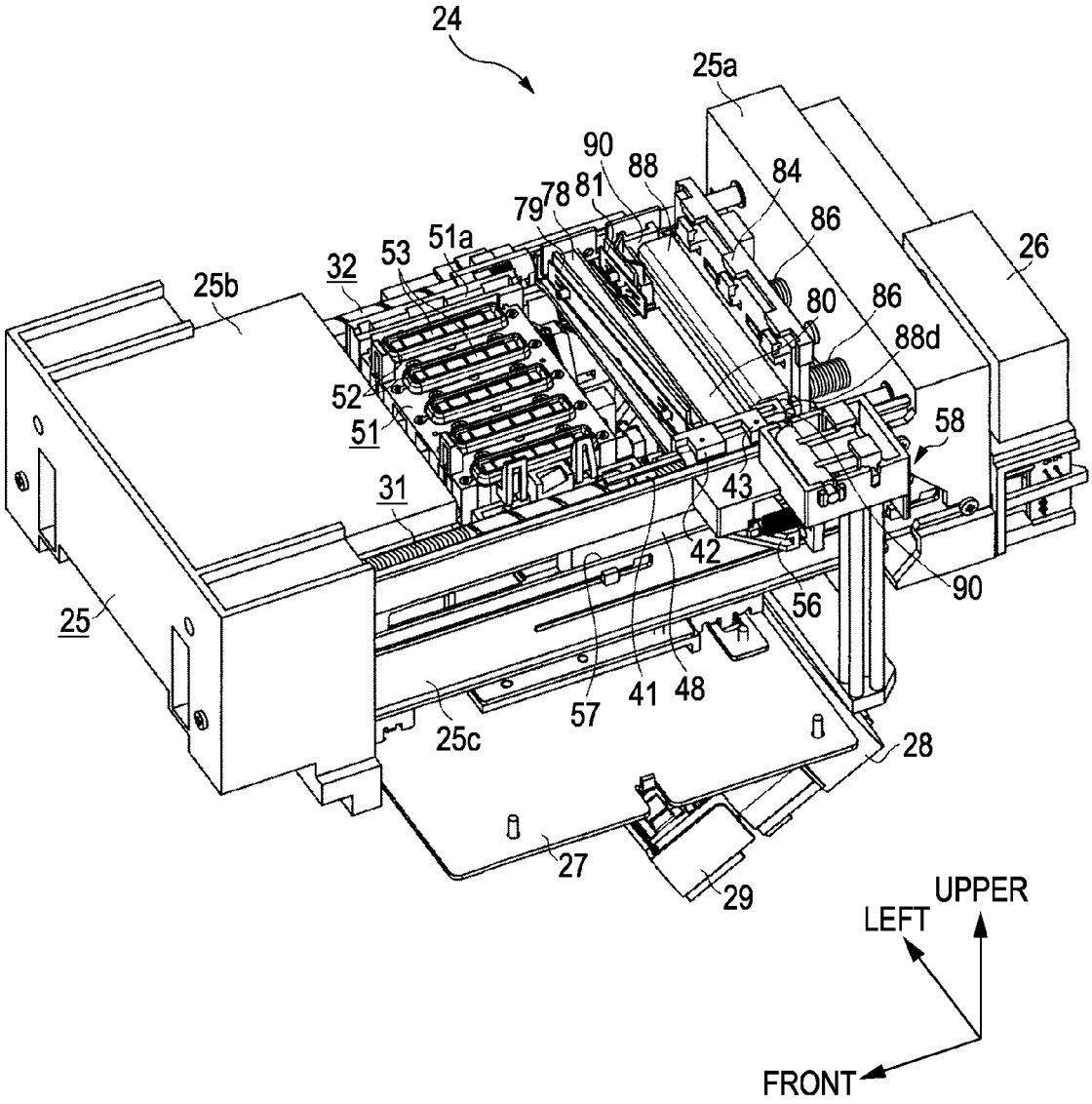
FIG. 3 is a perspective view of a maintenance unit when viewed from a right front side.
Figure 4:
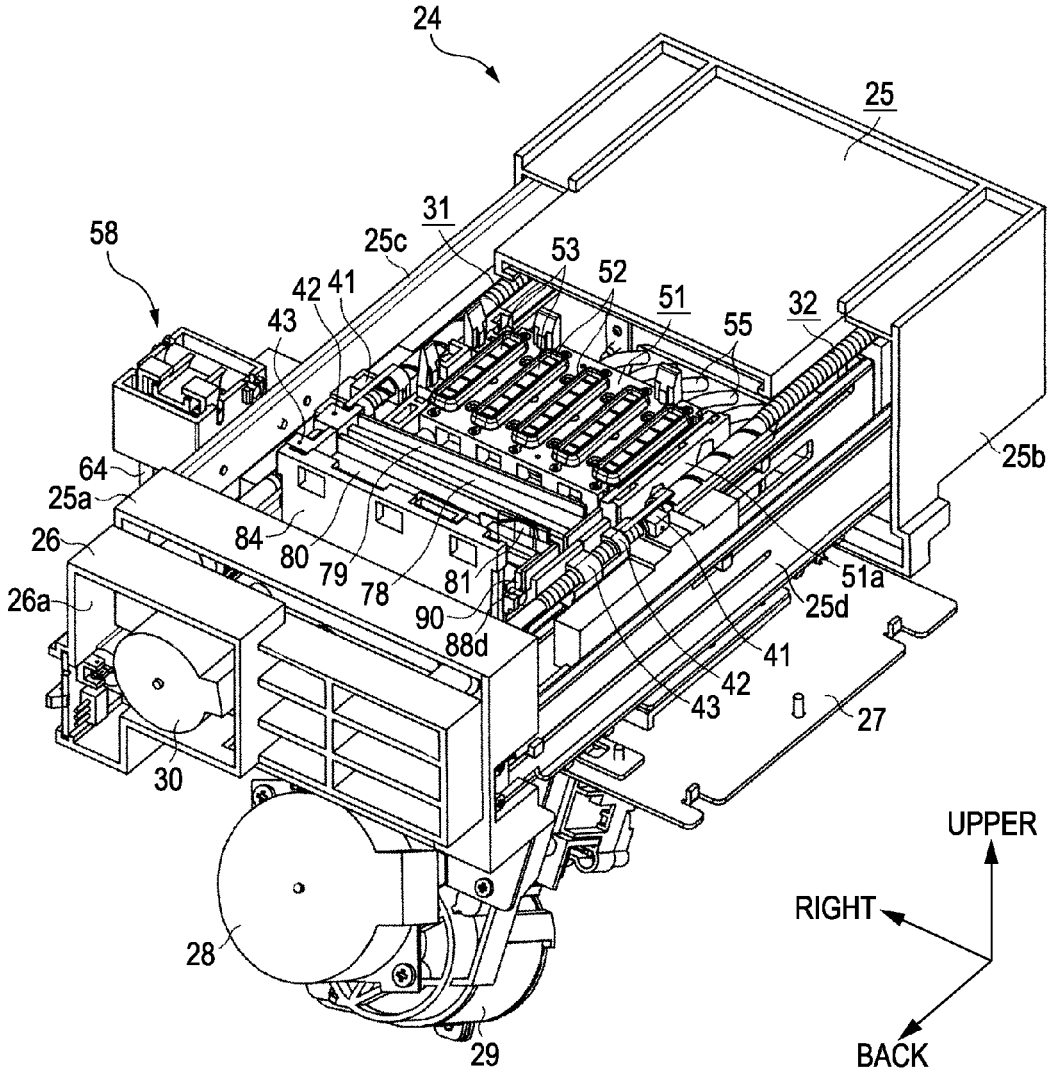
FIG. 4 is a perspective view of the maintenance unit when viewed from a left back side.

As shown in FIGS. 3 and 4, the maintenance unit 24 includes a unit body 25 having an approximately rectangular frame shape. The unit body 25 includes a back casing 25*a* having an approximately box shape and having an opened back side, a front casing 25*b* having an opened back side which has an approximately box shape larger than that of the back casing 25*a* in the front and back direction, a right frame 25*c* for connecting the right ends of the casings 25*a* and 25*b* and a left frame 25*d* for connecting the left ends of the casing 25*a* and 25*b*. An auxiliary casing 26 is attached to the back side of the back casing 25*a* in the unit body 25 so as to close the opened back side of the back casing 25*a*.

As shown in FIG. 4, an attachment plate 27 having a width larger than the width of the unit body 25 in the right-left direction is fixed to the lower side of the unit body 25 in a horizontal state, and a suction pump 29 is supported on the attachment plate 27 in a slop shape via an attachment bracket (not shown). The suction pump 29 is a suction unit including a pump motor 28 and a tube pump. An attachment plate 27 of the unit body 25 is supported by the main casing 11 via an attachment unit (not shown) such that the maintenance unit 24 is fixed to the lower position of the home position HP in the main casing 11 as shown in FIG. 1.

As shown in FIG. 4, in the maintenance unit 24, a driving motor 30 which is rotatable forward and backward is attached in the auxiliary casing 26. An output shaft (not shown) of the driving motor 30 passes through the auxiliary casing 26 and extends forward. A front end of the output shaft is positioned in the back casing 25*a* of the unit body 25.

Figure 5:
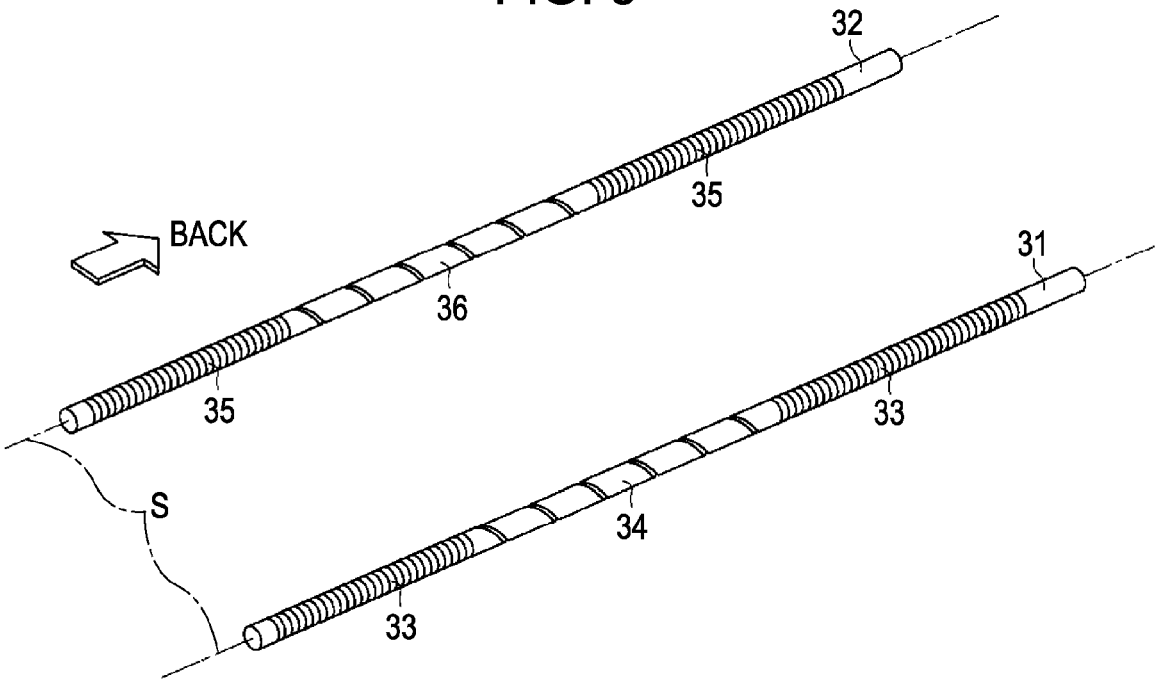
FIG. 5 is a perspective view of a lead screw.

As shown in FIGS. 3 and 4, a right lead screw 31 and a left lead screw 32 are rotatably installed between the back casing 25*a* and the front casing 25*b* of the unit body 25 on the upper side and the inside of the right and left frames 25*c* and 25*d* in a horizontal state along the front and back direction. As shown in FIG. 5, the lead screws 31 and 32 include first transporting screw portions 33 and 35 having relatively small pitches on the outer circumferences of the ends and second transporting screw portions 34 and 36 having relatively larger pitches on the outer circumferences of the central portions. The back end of the right lead screw 31 and the back end of the left lead screw 32 are introduced into the back casing 25*a* as shown in FIGS. 3 and 4.

Toothed pulleys (not shown) are respectively mounted on the back ends of the lead screws 31 and 32 and an endless pinion belt (not shown) is stretched over the teethed pulleys. The teethed pulley mounted on the back end of the right lead screw 31 is connected so as to deliver power to the front end of the output shaft of the driving motor 30 via a delivering gear (not shown). Accordingly, a driving force is generated by the driving motor 30 such that the right and left lead screws 31 and 32 synchronously rotate about their shaft lines S in the same direction.

Figure 6:
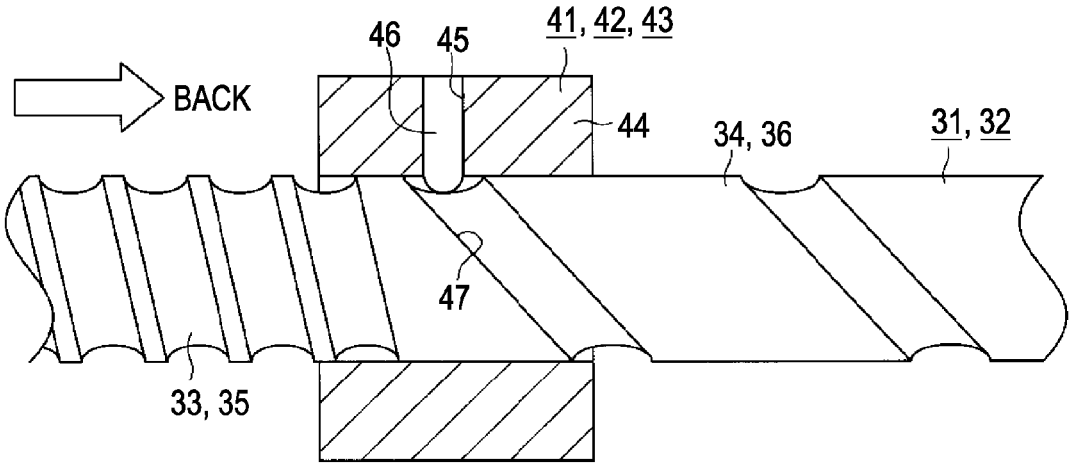
FIG. 6 is a cross-sectional view showing an engagement state of the lead screw and a cylindrical portion of a movement member.

As shown in FIGS. 3 and 4, a plurality of movement members 41, 42 and 43 are screwed with the right and left lead screws 31 and 32 along the shaft lines S. In the present embodiment, there are six movement members. All the movement members 41, 42 and 43 are mounted on the lead screws 31 and 32. As shown in FIG. 6, in the movement members 41, 42 and 43, holes 45 penetrate through portions of cylindrical portions 44 which house the lead screws 31 and 32 and pins 46 are fitted into the holes 45 as an engagement unit.

In the cylindrical portions 44, the front ends of the pins 46 are engaged with screw grooves 47 which are helically continuously formed in the first transporting screw portions 33 and 35 and the second transporting screw portions 34 and 36 of the lead screws 31 and 32. Accordingly, the pins 46 are engaged with the screw grooves 47 when the lead screws 31 and 32 are rotated, such that the right and left movement members 41 to 43 sequentially move forward and backward along the shaft lines S of the lead screws 31 and 32. More specifically, since the size of the pitch of the screw grooves 47 with which the pins 46 changes halfway through the shaft lines S of the lead screws 31 and 32, the movement speeds of the movement members 41 to 43 are changed by the change in the pitch size of the screw grooves 47 although the rotation speeds of the lead screws 31 and 32 are constant. That is, the speed of the movement members 41 to 43 are decreased in the first transporting screw portions 33 and 35 having the relatively small pitch size and is increased in the second transporting screw portions 34 and 36 having the relatively large pitch size.

The movement members 41 to 43 are spaced apart from each other along the shaft lines S of the lead screws 31 and 32 such that no two of the movement members are simultaneously engaged with the second transporting screw portions 34 and 36 and only one movement member is engaged with the second transporting screw portion at the same time. That is, the number of pitches between the pins 46 of the movement members 41 to 43 along the shaft lines S of the lead screws 31 and 32 are set to be equal to or larger than the number of pitches of the second transporting screw portions 34 and 36. Accordingly, when one movement member is engaged with the second transporting screw portions 34 and 36 at the time of the rotation of the lead screws 31 and 32, no other movement member is engaged with the second transporting screw portions 34 and 36. At this time, only one movement member engaged with the second transporting screw portions 34 and 36 moves at a high speed.

In the present embodiment, when the driving motor 30 is driven forward, both the lead screws 31 and 32 are rotated in a forward rotation direction and the movement members 41 to 43 move forward from the back casing 25*a* to the front casing 25*b*. In contrast, when the driving motor 30 is driven backward, both the lead screws 31 and 32 are rotated in a backward rotation direction and the movement members 41 to 43 moves backward from the front casing 25*b* to the back casing 25*a*.

Here, among the movement members 41 to 43, the movement members 41 which are positioned at the foremost side of the shaft directions S of the lead screws 31 and 32 are the movement members 41 for a cap unit and a valve unit, which deliver the driving forces based on the rotation of the lead screws 31 and 32 to the cap unit and the valve unit. The movement members 42 which are positioned second from the front side along the shaft lines S of the lead screws 31 and 32 are the movement members 42 for a wiping unit, which deliver the driving forces based on the rotation of the lead screws 31 and 32 to the wiping unit. The movement members 43 which are positioned at the backmost side along the shaft lines S of the lead screws 31 and 32 are the movement members 43 for a wiping unit and a liquid containing unit, which deliver the driving forces based on the rotation of the lead screws 31 and 32 to the wiping unit and the liquid containing unit.

First, the movement members 41 for the cap unit and the valve unit will be described.

As shown in FIGS. 7A to 9B, in each of the movement members 41 for the cap unit and the valve unit, rectangular plate portions 48 which are elongated in the front and back directions are integrally assembled to the insides of the right and left frames 25*c* and 25*d* of the unit body 25. In each of the plate portions 48, an elongated guide hole 49 functioning as a connection portion of the cap unit in each of the movement members 41 is formed. As shown in FIGS. 7A to 9B, the elongated guide hole 49 includes a back horizontal portion 49*a* which horizontally extends from the lower side of the back end to the middle of each of the plate portions, a slope portion 49*b* which obliquely extends from the front end 49*a* toward the upper front end of each of the plate portions 48, and a front horizontal portion 49*c* which horizontally extends from the front end of the slope portion 49*b* to the upper front end of each of the plate portions 48.

Figure 7A:
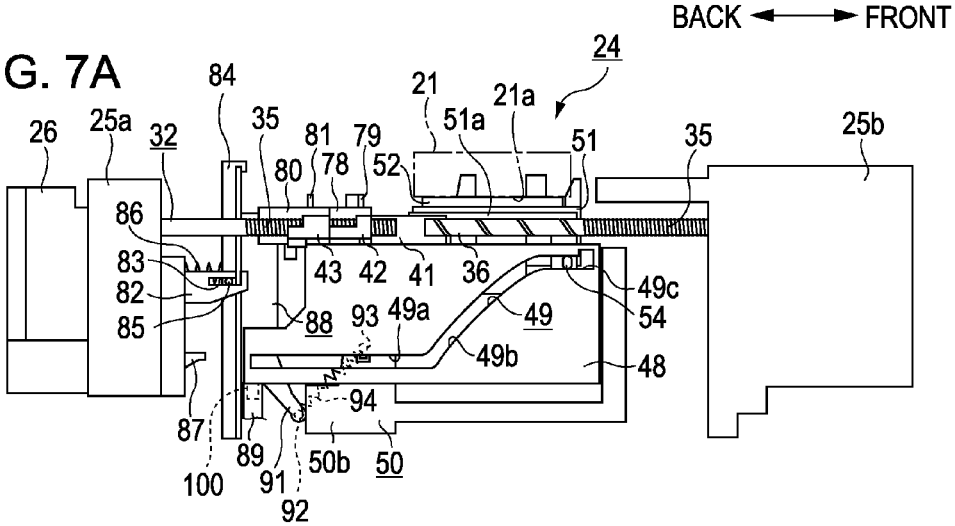
FIGS. 7A-7C are schematic views showing main portions of the maintenance unit with the cap member at different positions.
Figure 7B:
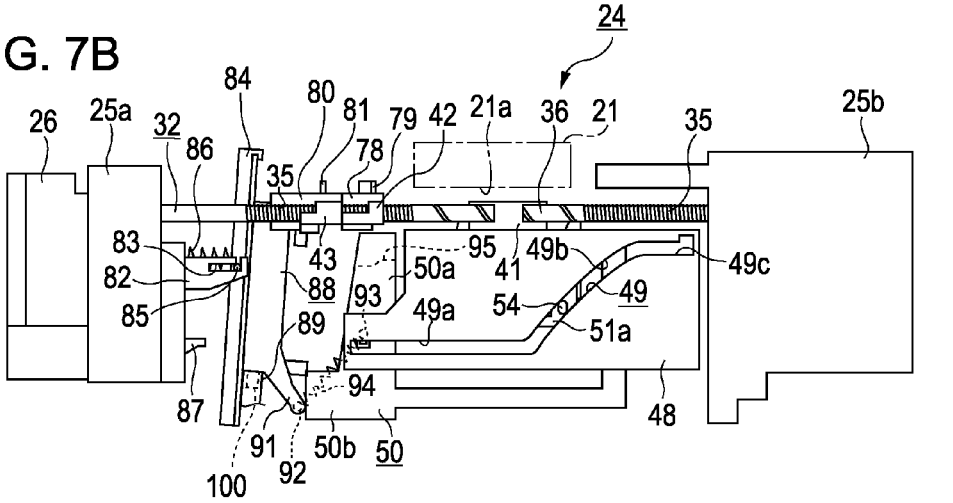
Figure 7C:
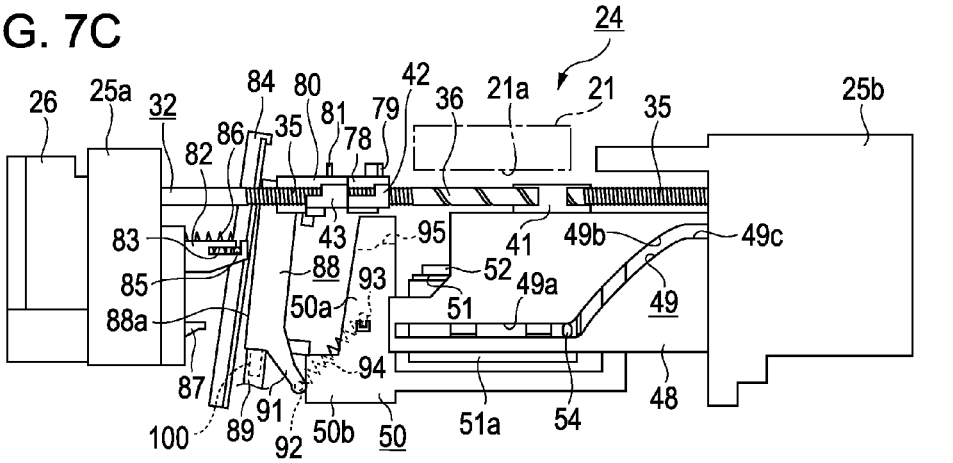
Figure 8:
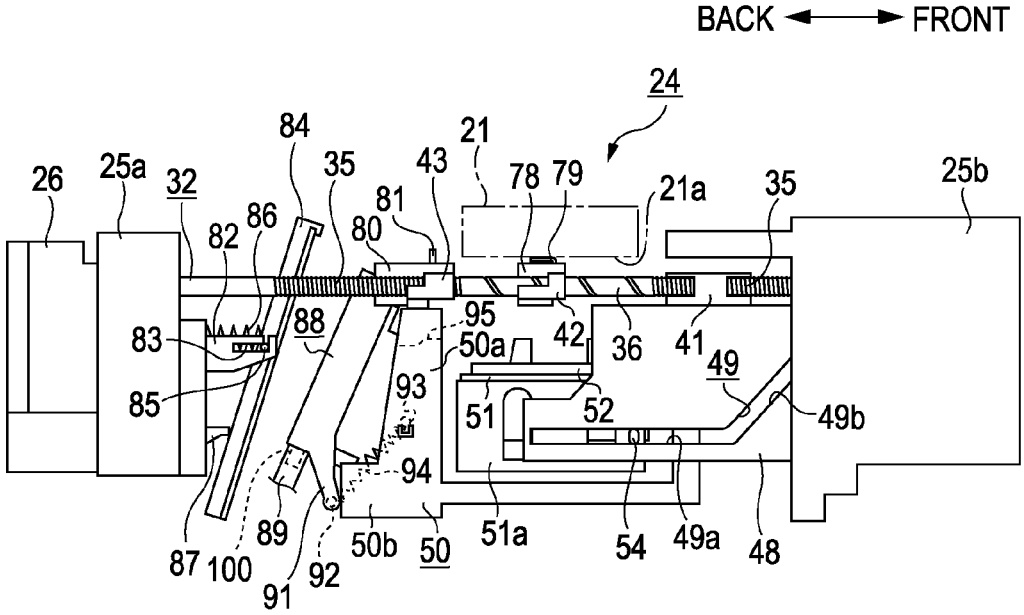
FIG. 8 is a schematic view showing the main portions of the maintenance unit in the case where a wiper member for all columns is positioned at a wiping position.
Figure 9A:
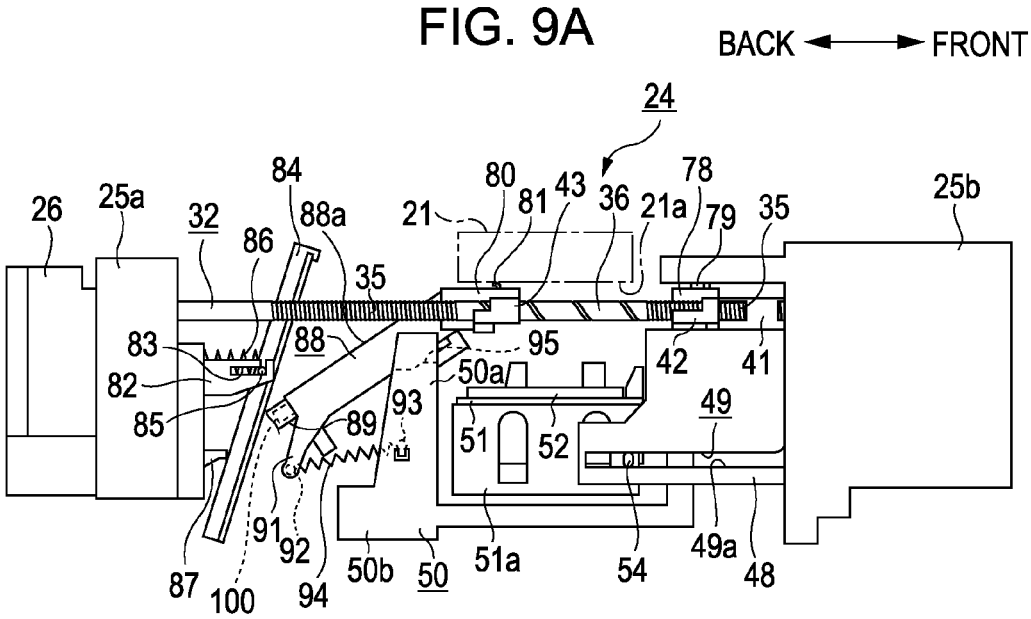
Figure 9B:
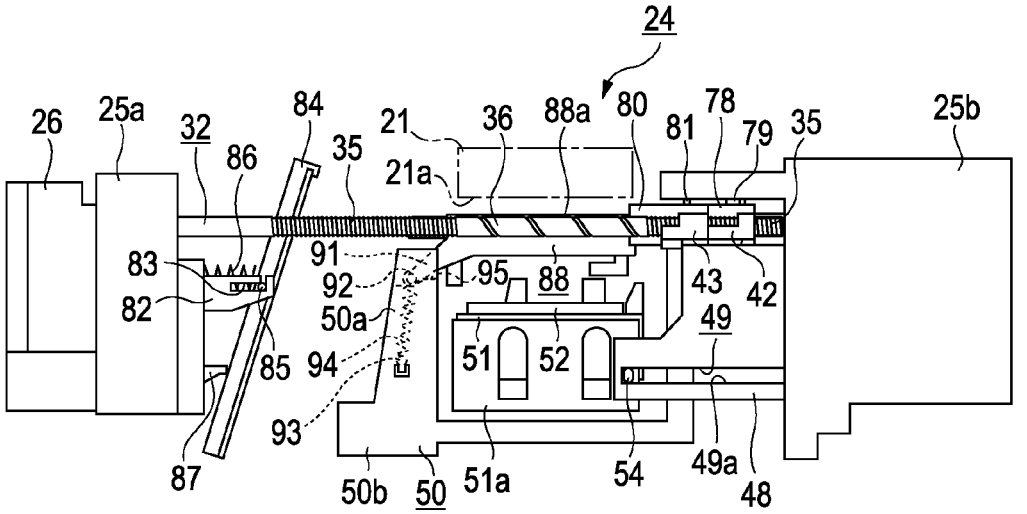

As shown in FIGS. 7A to 9B, at a position corresponding to the second transporting screws portions 34 and 36 and the insides of the plate portions 48, a holder member 50 having a rectangular frame shape having an opened upper side is arranged. A cap member 51 which comprises the cap unit in the holder member 50 is movably received in the upper and lower directions together, so as to be received by a cap holder 51*a* having a box shape. A coil spring (not shown) is interposed between the lower surface of the cap member 51 and the inner bottom surface of the cap holder 51*a* such that the cap member 51 is pressed upward. Since FIGS. 7 to 9 show the state in which the maintenance unit 24 is observed from the left side, only the left lead screw 32 and the transporting screw portions 35 and 36 of the right and left lead screws 31 and 32 are shown in FIGS. 7A to 9B.

Now, the cap member 51 configuring the cap unit will be described.

As shown in FIGS. 3 to 6 and FIGS. 7A to 9B, the cap member 51 has an approximately rectangular box shape and a plurality of rectangular annular seal portions, five in the present embodiment, which correspond to the nozzle arrays 22A, 22B, 22C, 22D and 22E formed in the nozzle forming surface 21*a* of the recording head 21. Ink absorbers 53 are received in cap chambers (not shown) recessed in the seal portions 52 and absorb and hold the ink discharged from the nozzles 22 of the nozzle arrays 22A to 22E.

As shown in FIGS. 7A-7C, 9A, and 9B, a convex portion 54 horizontally protrudes from the outer surfaces of the right and left sidewalls of the cap holder 51*a* and is fitted into the elongated guide hole 49 of each of the plate portions 48. Accordingly, if the movement members 41 (and the plate portions 48) move forward and backward by the rotation of the lead screws 31 and 32, the convex portion 54 of the cap holder 51*a* slides in the elongated guide hole 49 of each of the plate portion 48, and more particularly, when the convex portion slides along the slope portions 49*b* of the elongated guide holes 49, the convex portion moves vertically.

That is, the cap member 51 becomes a contact position state when the cap member moves to the uppermost side when the convex portion 54 of the cap holder 51*a* is fitted into the front horizontal portion 49*c* of the elongated guide hole 49 of each of the plate portions 48, such that the nozzle arrays 22A to 22E corresponding to the seal portions 52 surround the nozzle forming surface 21*a* of the recording head 21. Meanwhile, the cap member 51 moves to a non-contact position state when the cap member moves to the lowermost side of the positions separated from the nozzle forming surface 21*a* of the recording head 21, when the convex portion 54 of the cap holder 51*a* is fitted into the back horizontal portion 49*a* of the elongated guide hole 49 of each of the plate portions 48.

When the movement members 41 pass through the second transporting screws 34 and 36 by the rotation of the lead screws 31 and 32, the cap member 51 slides to the slope portion 49*b* of the elongated guide hole 49 of each of the plate portions 48 in which the convex portion 54 of the cap holder 51*a* integrally moves with the movement members 41, causing the cap member 51 to move between the contact position and the non-contact position by the movement of the movement members 41.

As shown in FIG. 4, ink ejection tubes 55 are drawn from the front sidewall of the cap member 51 so as to correspond to the cap chambers for receiving the ink absorbers 53 and the ink ejection tubes 55 are introduced into the suction pump 29 supported by the attachment plate 27 located on the lower side of the unit body 25. If the cap member 51 is moved to the contact position state when the suction pump 29 is driven, the waste ink is sucked from the cap chamber via the ink ejection tubes 55 and is introduced to a waste ink tank (not shown) provided on the lower side of the main casing 11.

As shown in FIG. 3, a pressing piece 56 having an approximately triangular shape protrudes from the outer side surface of the plate portion 48. The pressing piece 56 is a connection unit for connecting a valve unit to the movement members 41 and protrudes outside the unit body 25 via a notched groove 57 formed in the right frame 25*c* in the front and back directions. If the movement members 41 (and the plate portions 48) moves forward and backward by the rotation of the lead screws 31 and 32, a standby opening plate device 58 is operated in order to move forward and backward in the front and back directions together with the movement members 41 (and the plate portions 48).

Next, movement members 42 for the wiping unit will be described.

As shown in FIGS. 3 to 6, a wiper holder 78 functioning as the connection unit for the wiping unit in the movement members 42 is provided so as to connect the pair of right and left movement members 42. On the upper surface of the wiper holder 78, a wiper member 79 constituting the wiping unit is mounted so as to be slightly sloped in the longitudinal direction of the wiper holder 78. The wiper member 79 moves forward and backward in the front and back direction by the movement of the movement members 42 (and the wiper holder 78) when the movement members 42 (and the wiper holder 78) move by the rotation of the lead screws 31 and 32.

Here, the wiper member 79 moves in the front and back direction while the front end (top end) thereof is brought into contact with the nozzle forming surface 21*a* of the recording head 21 such that the wiper member 79 wipes the overall surface of the nozzle forming surface 21*a* is configured so as to cover all the nozzle arrays 22A to 22E formed in the nozzle forming surface 21*a*. Accordingly, if the movement members 42 passes through the second transporting screws 34 and 36 by the rotation of the lead screws 31 and 32 in a state in which the carriage 16 (and the recording head 21) is positioned at the home position HP, the whole surface of the nozzle forming surface 21*a* of the recording head 21 is wiped by the wiper member 79.

Next, movement members for the wiping unit and the liquid containing unit will be described.

As shown in FIGS. 3 to 6, in the movement members 43 for the wiping unit and the liquid containing unit, a wiper holder 80 functioning as the connection unit for the movement members 43. On the upper surface of the wiper holder 80, a wiper member 81 constituting the wiping unit is mounted in the vicinity of the left end of the wiper holder 80 in the longitudinal direction. The wiper member 81 moves forward and backward in the front and back direction by the movement of the movement members 43 and the wiper holder 80. More specifically, when the movement members 43 and the wiper holder 80 move forward and backward in the front and back directions by the rotation of the lead screws 31 and 32, the wiper member 81 moves forward and backward.

As shown in FIGS. 7A to 9B, a pair of right and left support pieces 82 protrude forward from the front wall surface of the back casing 25*a* of the unit body 25. Notch grooves 83 are formed from the edges of the front ends of the support pieces 82 in a hooked shape. A seal plate having a rectangular plate shape and having a front surface of a seal surface is interposed between the right and left support pieces 82 and the seal plate 84 is fitted into the notch grooves 83 of the support pieces 82 corresponding to an axial portion 85 protruding from the right and left end surfaces in the horizontal direction so as to rotate about the axial portion 85.

A coil spring 86 is interposed between the front wall surface of the back casing 25*a* and the back surface of the seal plate 84 at a position slightly above the support pieces 82. The seal plate 84 rotates about the axial portion 85 in a clockwise direction of FIGS. 7A to 9B by the force of the coil spring 86. A protrusion 87 functioning as a stopper protrudes forward from the front wall of the back casing 25*a* at a position below the support pieces 82. The protrusion 87 restricts the rotation of the seal plate 84 in the clockwise direction when the lower portion of the back of the seal plate 84 rotated by the force of the coil spring 86 is brought into contact with the protrusion 87.

Figure 10A:
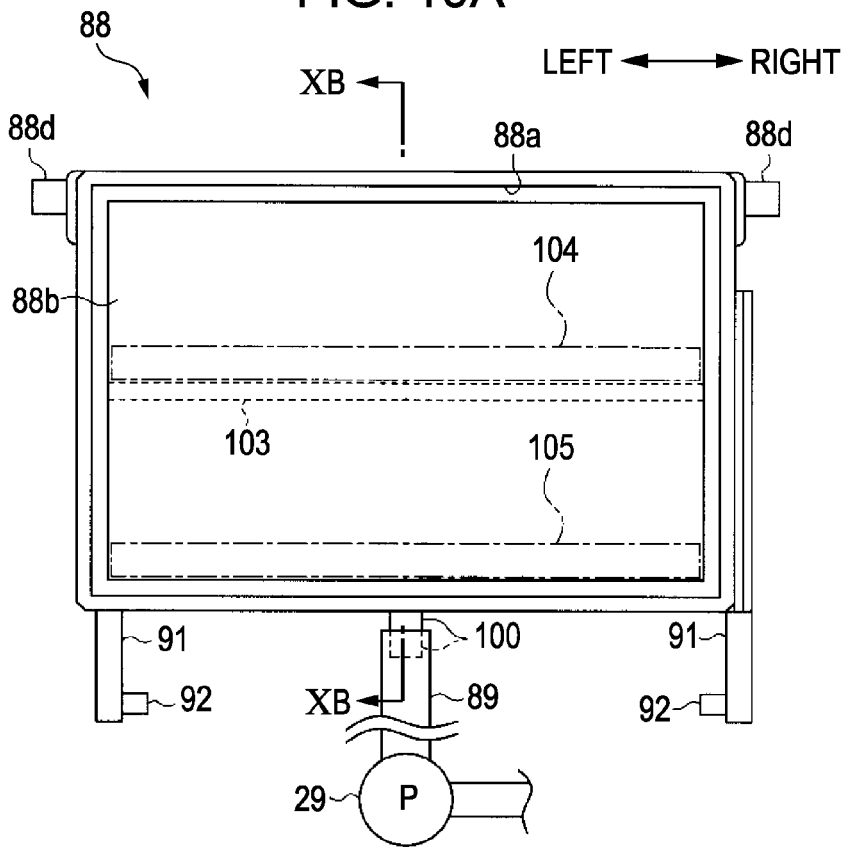
FIG. 10A is a plan view of the flushing box.
Figure 10B:
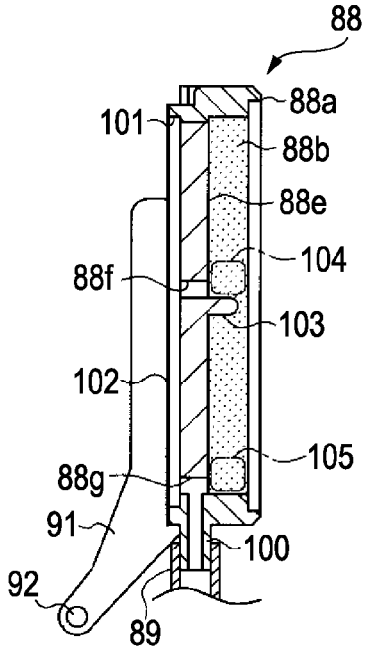
FIG. 10B is a cross-sectional view taken along line XB-XB of FIG. 10A.

As shown in FIGS. 3 and 7A to 9B, a flushing box 88 comprising a liquid containing body is interposed between the seal plate 84 and the wiper holder 80. As shown in FIGS. 10A and 10B, the flushing box 88 is a box having a bottom which includes an opening 88*a* having a rectangular shape which corresponds to the nozzle forming surface 21*a* of the recording head 21 and the absorber 88*b* having the same material of the ink absorbers 53 received in the cap chamber of the cap member 51.

As shown in FIGS. 7A-7C and 10A-10B, an ink ejection portion 100 comprising a connection channel is formed in the center portion of one side (a lower side of FIG. 7A) of the flushing box 88. The ink ejection portion 100 is connected such that one end of a waste liquid tube 89 communicates with the inside of the flushing box 88. The other end of the waste liquid tube 89 is introduced into the suction pump 29 and into the waste ink tank (not shown) provided on the lower side of the main casing 11.

As shown in FIGS. 3 and 10A, a pair of right and left pin portions 88*d* horizontally protrude from the right and left ends of each end of the flushing box 88. The pin portions 88*d* are rotatably supported with respect to the pair of right and left support pieces 90 protruding from the right and left back ends of the wiper holder 80. Accordingly, the pair of right and left pin portions 88*d* are rotatably supported by the pair of right and left support pieces 90 protruding from the back surface of the wiper holder 80 such that the flushing box 88 is rotatably supported by the pin portions 88*d* of the other end (the lower end of FIG. 3) as the rotation point with respect to the wiper holder 80.

As shown in FIGS. 3 and 7A, when the flushing box 88 does not receive the ink ejected from the recording head 21 as the waste ink (waste material), the opening 88*a* is held at a non-reception position perpendicular to the reception position, and the opening 88*a* is closed by the front surface which is the seal surface of the seal plate 84. That is, the opening 88*a* is closed by the seal plate 84 such that the absorber 88*b* received in the flushing box 88 suppresses the absorbed ink from solidifying.

As shown in FIGS. 10A and 10B, a pair of right and left leg portions 91 shaped like plates are formed so as to integrally extend from the right and left ends of the flushing box 88. The leg portions 91 slope from the bottom of the flushing box 88 and a pin portion 92 horizontally protrudes from the insides of the front ends of the leg portions 91. The right and left positions of the leg portions 91 correspond to those of the base portions 50*b* of the of right and left columnar support portions 50*a*, and, as shown in FIGS. 7A, 7B, 7C, the leg portions 91 are brought into contact with the base portions 50*b* of the corresponding columnar support portions 50*a* when the flushing box 88 is in an approximately perpendicular when not being used.

Figure 11:
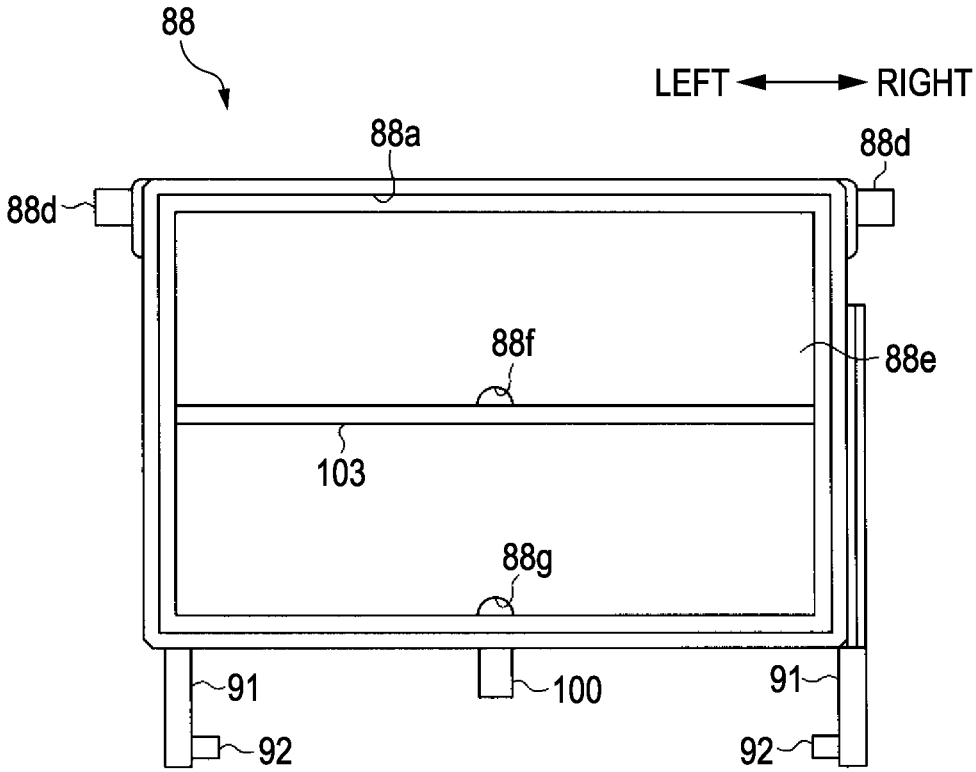
FIG. 11 is a plan view showing the shape of the bottom of the flushing box.

In the center of the bottom of the flushing box 88 as shown in FIGS. 10A and 10B, a concave groove 101 which extends from one end to the other is formed so as to communicate with the ink ejection portion 100. In addition, the concave groove 101 is closed by a coating film 102. As shown in FIGS. 10B and 11, the bottom 88*e* of the flushing box 88 is formed in a nonplanar shape. In more detail, in the middle of the bottom 88*e* of the flushing box 88 in the upper and lower directions of FIG. 11, a projection 103 is formed as a restriction portion which extends from the right end to the left end.

In addition, on the projection 103 of the bottom wall of the flushing box 88 in the upper and lower directions of FIG. 11 and in the central portion of the flushing box 88 in the right and left directions, a first communication hole 88*f* is formed as a communication portion for communicating with the inside of the concave groove 101. On the lower sidewall of FIG. 11 of the bottom wall of the flushing box 88 and in the central portion of the flushing box 88 in the right and left direction, a second communication hole 88*g* is formed as a communication portion for communicating with the inside of the concave groove 101. In addition, the surface of the absorber 88*b* opposite to the inside bottom surface 88*e* of the flushing box 88 corresponds to the inside bottom surface 88*e* so as to be brought into contact with the inside bottom surface 88*e*.

A pair of pin portions 93 horizontally protrude from the inside of the middle position in the height direction of both the right and left columnar support portions 50*a* of the holder member 50 so as to correspond to the pin portions 92 of the leg portions 91 of the flushing box 88, as shown in FIGS. 7A, 7B and 7C. A coil spring 94 is interposed between the pin portions 92 and the pin portions 93 and the flushing box 88 is rotatably forced by the force of the coil spring 94 in the direction (counterclockwise, in FIGS. 7 to 9) in which the leg portions 91 are pressed to the base portions 50*b* of the columnar support portions 50*a* of the holder member 50 by the pin portion 88*d*.

As shown in FIGS. 7 to 9, at a position apart from the upper end of the inner surfaces of the right and left columnar support portions 50*a* of the holder member 50 by a distance corresponding to the depth of the flushing box 88, a large-width step difference portion 95 is formed such that the distance between the opposite surfaces of both the right and left columnar support portions 50*a* is slightly larger than the width of the flushing box 88 in the right and left directions. That is, the flushing box 88 can move forward and backward by passing the upper side of the large-width step difference portion 95 between the right and left columnar support portions 50*a* of the holder member 50.

Accordingly, the flushing box 88 moves forward and backward in the front and back direction by the movement of the movement members 43 (and the wiper holder 80) when the movement members 43 (and the wiper holder 80) move forward and backward in the front and back directions by the rotation of the lead screws 31 and 32. That is, the flushing box 88 around the pair of pin portions 88*d* supported by the support pieces 90 of the wiper holder 80 to the movement members 43 when the movement members 43 pass through the second transporting screws 34 and 36 by the rotation of the lead screws 31 and 32. By moving the pin portions 88*d*, the flushing box 88 moves forward and backward between the reception position (see FIG. 9B) of the horizontal position state where the opening 88*a* approaches and faces the nozzle forming surface 21*a* of the recording head 21 and the non-reception position (see FIG. 7A) where the opening 88*a* is spaced away from the reception position.

In more detail, when the movement members 43 move forward, the flushing box 88 first moves to a slope position state where the bottom of the movement members 43 is in contact with the large-width step difference portion 95, as shown in FIG. 9A, while receiving the force of the coil spring 94 by using the pin portions 88*d* as the rotation points. Then, when the slope position state is changed to the horizontal position state, the movement members 43 move forward together. When the movement members 43 further move forward, the flushing box 88 moves to the horizontal position state where the leg portions 91 are brought into contact with the large-width step difference portion 95 and, finally, the front ends of the leg portions 91 are brought into contact with the large-width step difference portion 95, as shown in FIG. 9B.

While the movement members 43 move forward, the flushing box 88 is stably moved from the vertical position state to the horizontal position state by bringing the bottom and the leg portions 91 thereof into contact with the large-width step difference portion 95. In the horizontal position state of the reception position, the front ends of the leg portions 91 are held in contact with the large-width step difference portion 95 by the force of the coil spring 94.

In contrast, when the movement members 43 move backward, the flushing box 88 moves from the reception position to the non-reception position. In this case, similar to the case where the movement members 43 move forward, the flushing box 88 is gradually moved from the horizontal position state to the vertical position state by slope position state where the bottom and the leg portions 91 thereof are in contact with the large-width step difference 95, while receiving the force of the coil spring 94. As shown in FIG. 7A, in the vertical position of the non-reception position, in addition to the force of the coil spring 94, the force of the coil spring 86 is applied from the opposite direction of the force of the coil spring 94 via the seal plate 84 such that the vertical position state is secured. Accordingly, in the present embodiment, a movement mechanism for moving the flushing box 88 between the reception position and the non-reception position by the driving motor 30, the lead screws 31 and 32 and the movement members 43 is constituted.

Next, the operation of the printer 10 according to the present embodiment after flushing will be described.

At the time of flushing, the lead screws 31 and 32 rotate forward by driving the driving motor 30. Then, the flushing box 88 positioned at the non-reception position moves toward the reception position. If the movement of the flushing box 88 to the reception position is completed, the driving of the driving motor 30 is completed. When the carriage 16 moves to the home position HP, the ink is ejected from the nozzles 22 of the recording head 21 mounted in the carriage 16 into the flushing box 88 as waste. The ink is absorbed into and held in the absorber 88*b* of the flushing box 88.

Thereafter, the carriage 16 moves from the home position HP to the left side and the flushing box 88 is moved and held at the non-reception position on the due to the backward rotation of the lead screws 31 and 32. That is, the flushing box 88 is moved to a state in which the inside bottom surface 88*e* thereof is sloped with respect to the horizontal plane. As a result, in the absorber 88*b* of the flushing box 88, the ink flows to the gravity-direction lower side along the inside bottom surface 88*e*.

However, as shown in FIG. 10B, the flow of the ink which exists on the gravity-direction upper side than the projection 103 of the flushing box 88 positioned at the non-reception position to the gravity-direction lower side than the projection 103 is restricted. As a result, on the projection 103, a first collection portion 104 in which the ink is easily collected is formed at a region surrounded by a dashed-dotted line in FIG. 10A. The ink which exists on the gravity-direction lower side than the projection 103 of the flushing box 88 positioned at the non-reception position flows to the other end (the lower end of FIG. 10B) of the absorber 88*b*. As a result, a second collection portion 105 is formed where the ink stored in the lower side of the absorber 88*b* is formed, shown by the dashed-dotted line in FIG. 10A, where the ink may be easily collected.

When the suction pump 29 for sucking the ink in the flushing box 88 is driven in this state, the ink collected in the collection portions 104 and 105 of the absorber 88*b* flows into the communication holes 88*f* and 88*g* corresponding to the collection portions 104 and 105. Thereafter, the ink flowing from the communication holes 88*f* and 88*g* into the ink ejection portion 100 via the concave groove 101 is sucked into the suction pump 29 via the waste liquid tube 89 and is ejected from the suction pump 29 into the waste ink tank (not shown).

Accordingly, the following effects can be obtained in the present embodiment.

(1) In the absorber 88*b* of the flushing box 88 positioned at the non-reception position in which the inside bottom surface 88*e* is sloped with respect to the horizontal plane, the collection portions 104 and 105 are formed at a plurality of different positions, with different elevations. Accordingly, it is possible to improve the ink holding capability of the absorber 88*b* to twice of that of the case where only one collection portion is formed in the absorber 88*b*. Accordingly, before the collection portions 104 and 105 of the absorber 88*b* are saturated, the number of times of driving of the suction pump 29 for ejecting the ink held in the absorber 88*b* out of the flushing box 88 to about a half of that of the case where only one collection portion is formed in the absorber 88*b*. Accordingly, it is possible to reduce the load applied to the suction pump 29 by efficiently bringing out the ink holding capability of the absorber 88*b* provided in the flushing box 88 of which the inside bottom surface 88*e* is sloped with respect to the horizontal plane.

(2) In the present embodiment, the projection 103 is formed on the inside bottom surface 88*e* of the flushing box 88 such that the inside bottom surface 88*e* is formed in a nonplanar shape. When the flushing box 88 is positioned at the non-reception position, the collection portions 104 and 105 are formed in the absorber 88*b* at the plurality of elevations. Accordingly, it is possible to improve the ink holding capability of the absorber 88*b* without providing a member separate from the flushing box 88.

(3) The restriction portion is the projection 103 which protrudes from the inside bottom surface 88*e* toward the opening 88*a*. Accordingly, in the first collection portion 104 located with a higher elevation than the projection 103, the ink ejected from the recording head 21 into the flushing box 88 as the waste ink can be held with certainty.

(4) The communication holes 88*f* and 88*g* are formed in the absorber 88*b* at position corresponding to the collection portions 104 and 105. Accordingly, when the ink held in the absorber 88*b* is discharged from the flushing box 88 by the suction force of the suction pump 29, the ink can be more efficiently sucked from the collection portions 104 and 105 of the absorber 88*b* and discharged from the flushing box 88, as compared with the case where only one communication hole is formed in the flushing box 88. Accordingly, it is possible to reduce the driving time of the suction pump 29 compared with the case where only one communication hole is formed in the flushing box 88.

(5) Although the flushing box 88 moves from the reception position to the non-reception position, most of the ink held in the absorber 88*b* is held in the collection portions 104 and 105 of the absorber 88*b*. Accordingly, it is possible to suppress the ink in the absorber 88*b* from leaking when the flushing box 88 moves to the non-reception position, as compared to the case where only one collection portion is formed in the absorber 88*b*.

Second Embodiment

Next, a second embodiment of the invention will be described with reference to FIGS. 12 and 13. In the second embodiment, portions different from those of the first embodiment will be described and the same members as the first embodiment are denoted by the same reference numerals and thus the description thereof will be omitted.

Figure 12:
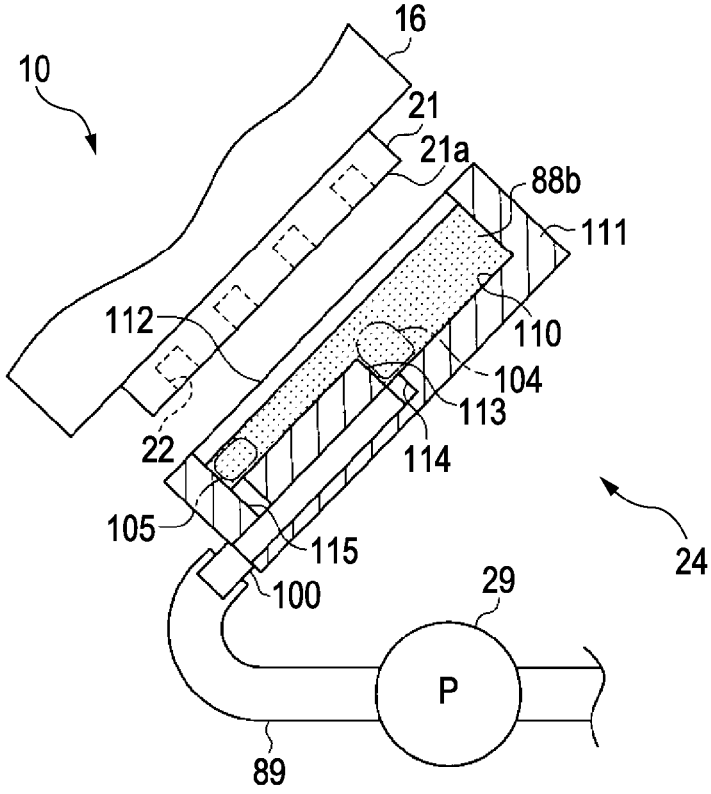
FIG. 12 is a view of a printer according to a second embodiment of the invention.
Figure 13:
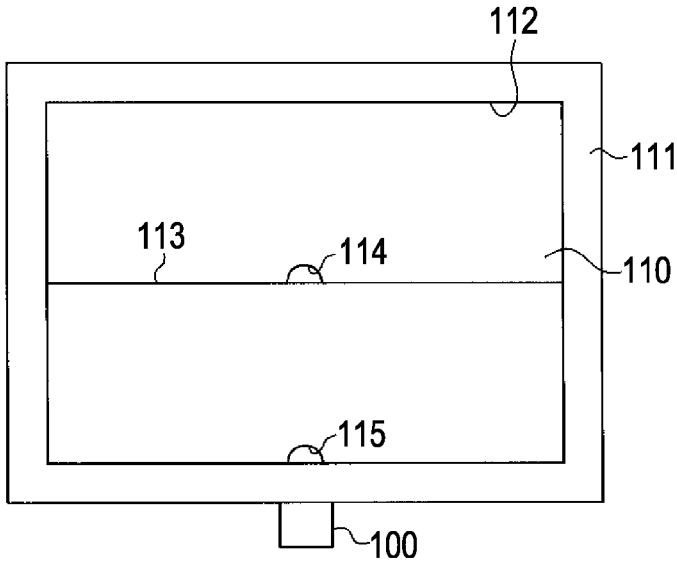
FIG. 13 is a schematic plan view showing the shape of the bottom of a flushing box.

As shown in FIG. 12, in a printer 10 according to the present embodiment, a recording head 21 with a sloped nozzle forming surface 21*a* with respect to a horizontal plane is provided. Below the home position HP, a flushing box 111 of which the inner bottom 110 is substantially parallel to the nozzle forming surface 21*a* of the recording head 21 is provided. As shown in FIGS. 12 and 13, in the flushing box 111, an opening 112 is formed in a side opposite to the recording head 21 positioned at the home position HP.

In a middle portion of the inner bottom 110 of the flushing box 111 in the upper and lower directions, a step difference portion 113 which extends in the right and left direction is formed. The interval between the inner bottom 110 located above the step difference portion 113 and the opening 112 is larger than the interval between the inner bottom 110 located below than the step difference portion 113 and the opening 112. Communication holes 114 and 115 are formed on the step difference portion 113 of the bottom wall of the flushing box 111 and in the central portion of the lower end in the right and left directions.

When a flushing operation is performed from the recording head 21 positioned at the home position HP, the ink ejected from the recording head 21 is absorbed by the absorber 88*b* of the flushing box 111. Then, the ink held in the absorber 88*b* flows downward along the inner bottom 110 in the absorber 88*b*. However, the flow of the ink located above the step difference portion 113 in the absorber 88*b* is restricted to the lower side of the step difference portion 113 by the step difference portion 113 and, as a result, the first collection portion 104 is formed on the step difference portion 113. The ink located below the step difference portion 113 is moved to the lower end of the absorber 88*b* and held in a state of being collected in the vicinity of the lower end. That is, the second collection portion 105 is formed in the lower end of the absorber 88*b*. Accordingly, in the present embodiment, the same effects as the effects (1) to (4) of the first embodiment can be obtained.

The above-described embodiments may be changed to the following embodiments.

In another embodiment, the number of communication holes formed in the bottom wall of the flushing boxes 88 and 111 may be one. Using this configuration, the ink held in the collection portions 104 and 105 of the absorber 88*b* can be discharged from the flushing boxes 88 and 111 by the suction force of the suction pump 29.

In the first embodiment, a plurality of projections 103 which extend from the right end to the left end may be formed in the inside bottom surface 88*e* of the flushing box 88. For example, if three projections 103 are formed in the inside bottom surface 88*e* of the flushing box 88, four different collection portions are formed in the absorber 88*b*.

In the second embodiment, a plurality of step difference portions 113 may be formed in the inner bottom 110 of the flushing box 111. For example, if two step difference portions 113 are formed in the inner bottom 110 of the flushing box 111, three different collection portions are formed in the absorber 88*b*.

In the first embodiment, the step difference portion 113 as well as the projection 103 may be formed in the inside bottom surface 88*e* of the flushing box 88. The step difference portion 113 and the projection 103 may be also be formed in the inside bottom surface 88*e* of the flushing box 88.

Similarly, in the second embodiment, the projection 103 and step difference portion 113 may be formed in the inner bottom 110 of the flushing box 111. The projection 103 and step difference portion 113 may be formed in the inner bottom 110 of the flushing box 111.

Figure 14:
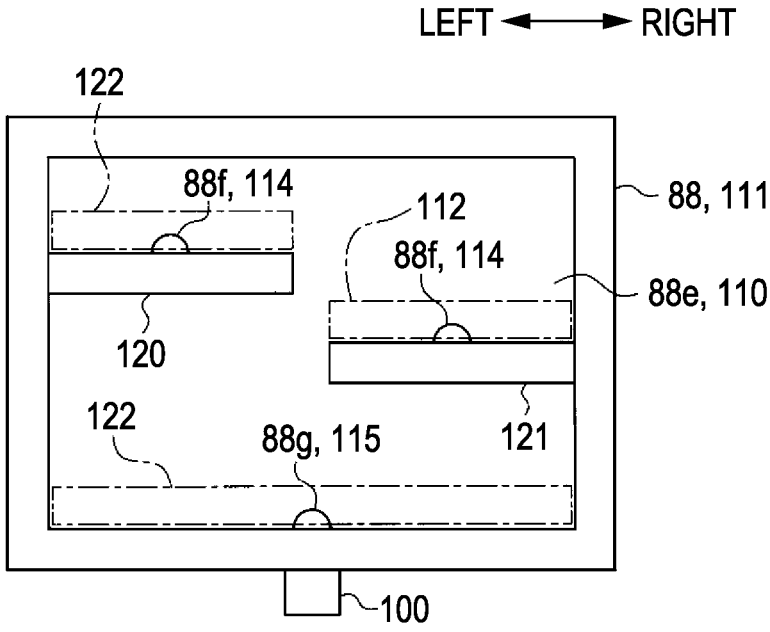
FIG. 14 is a schematic view showing a flushing box according to another embodiment.

In the embodiments, a first projection 120 which extends from the left end to a middle portion and a second projection 121 which extends from the right end to the middle portion may be formed in the inner bottoms 88*e* and 110 of the flushing boxes 88 and 111, as shown in FIG. 14. By this configuration, a collection portion 122 is formed in absorber 88*b* at positions above the projections 120 and 121 in FIG. 14.

Figure 15:
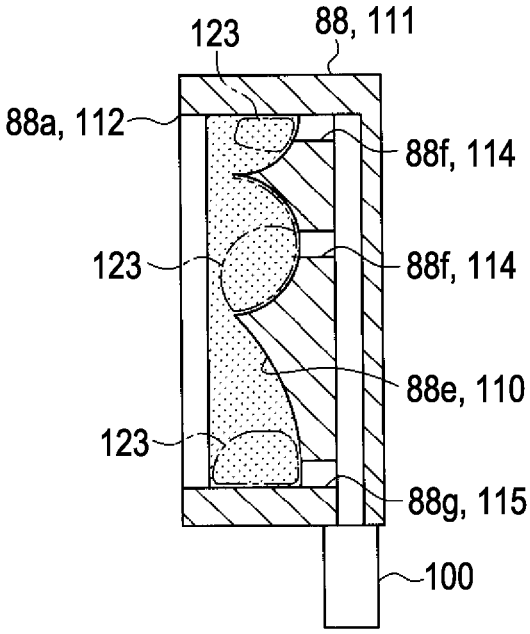
FIG. 15 is a schematic view showing a flushing box according to another embodiment.

In the embodiments, the inner bottoms 88*e* and 110 of the flushing boxes 88 and 111 may be formed in a wave shape in a side view, as shown in FIG. 15. In this case, portions acting as restriction portions may protrude from the inner bottoms 88*e* and 110. Accordingly, in the absorber 88*b*, a collection portion 123 is formed below the inner bottoms 88*e* and 110 in an area spaced farthest from the opening 88*a* and 112 of the flushing boxes 88 and 111.

In the first embodiment, the projection 103 may be formed by attaching a long member separately from the flushing box 88 to the inside bottom surface 88*e* of the flushing box 88.

In the embodiments, a number of absorbers received in the flushing boxes 88 and 111 may be used (for example, two). For example, a first absorber may be disposed on the upper side of the restriction portion and a second absorber may be disposed on the lower side of the restriction portion.

In the embodiments, the liquid ejecting apparatus may be applied to a full line type printer in which the recording head 21 has a shape corresponding to the length of the sheet P in width-direction (the right and left directions) in a direction orthogonal to the transporting direction (the front and back directions) of the sheet P.

Although, in the embodiments, the liquid ejecting apparatus is applied to the ink jet type printer 10, it may be applied to other liquid ejecting apparatuses for ejecting or discharging liquid (also called a liquid material) other than the ink or liquid such as gel (also called a fluid material). For example, it may be applied to a liquid ejecting apparatus for ejecting a material such as an electrode material or a coloring material (pixel material) dispersed or melted therein, which is used for manufacturing of a liquid crystal display, an electroluminescence (EL) display and a surface emission display, or in a liquid ejecting apparatus for ejecting a bio organic matter used for manufacturing biochips, or in a liquid ejecting apparatus for ejecting a sample of liquid used as a precision pipet. In addition, it may be applied in a liquid ejecting apparatus for ejecting a pinpoint of lubricant to a precision machine such as a watch or a camera, or in a liquid ejecting apparatus for ejecting transparent resin liquid such as ultraviolet curing resin onto a substrate in order to form a minute semi-spherical lens (optical lens) used in an optical communication device, or in a liquid ejecting apparatus for ejecting an etchant such as acid or alkali in order to etch a substrate, or in a liquid ejecting apparatus for ejecting liquid such as gel (for example, physical gel). Thus, the invention may be applied to a number of liquid ejecting apparatuses.

What is claimed is:

1. A liquid ejecting apparatus comprising:

a liquid ejecting head capable of ejecting liquid through a plurality of nozzles;

a liquid container capable of receiving the liquid ejected as a waste material from the plurality of nozzles of the liquid ejecting head;

an absorber disposed in the bottom of the liquid container which is capable of absorbing and storing the waste material;

a suction unit capable of sucking the waste material held by the absorber and discharging the waste material from the liquid container, and a movement mechanism which moves the liquid container between a reception position where the liquid ejected as the waste material can be received from the nozzles of the liquid ejecting head and a non-reception position where the liquid ejected as the waste material cannot be received from the nozzles;

wherein the liquid container comprises a restriction portion capable of restricting the flow of the waste material to a portion of the absorber with a lower elevation, the restriction portion protruding from an inside bottom surface of the liquid container toward an opening of the liquid container and extending from a first end to a second end of the liquid container, and the absorber comprises collection portions at a plurality of positions with different elevations where the waste material may be collected when the liquid container is rotated so that the bottom surface is sloped away from the horizontal plane, wherein liquid container comprises a communication hole that is adjacent to and touching the restriction portion, the communication hole configured to provide the liquid to the suction unit.

2. A liquid ejecting apparatus comprising:

a liquid ejecting head capable of ejecting liquid through a plurality of nozzles;

a liquid container capable of receiving the liquid ejected as a waste material from the plurality of nozzles of the liquid ejecting head;

an absorber disposed in the bottom of the liquid container which is capable of absorbing and storing the waste material;

at least one protrusion portion formed in the bottom surface of the liquid container capable of restricting the flow of the waste material due to gravity, the at least one protrusion portion extending from a first end to a second end of the liquid container;

a suction unit capable of sucking the waste material held by the absorber and discharging the waste material from the liquid container;

a connection channel formed in the liquid container capable of connecting the liquid container and the suction unit, wherein the connection channel comprises a communication hole that is adjacent to and touching the restriction portion, the communication hole configured to provide the liquid to the connection channel; and a movement mechanism which moves the liquid container between a reception position where the liquid ejected as the waste material can be received from the nozzles of the liquid ejecting head and a non-reception position where the liquid ejected as the waste material cannot be received from the nozzles, wherein the absorber comprises collection portions corresponding to the at least one protrusion portion located at a plurality of positions with different elevations where the waste material may be collected when the liquid container is rotated so that the bottom surface is sloped away from the horizontal plane, wherein the communication units are formed at positions in the liquid container corresponding to the collection portions of the absorber.

3. A liquid ejecting apparatus comprising:

a liquid ejecting head capable of ejecting liquid through a plurality of nozzles;

a liquid container capable of receiving the liquid ejected as a waste material from the plurality of nozzles of the liquid ejecting head;

an absorber disposed in the bottom of the liquid container which is capable of absorbing and storing the waste material;

a suction unit capable of sucking the waste material held by the absorber and discharging the waste material from the liquid container; and a movement mechanism which moves the liquid container between a reception position where the liquid ejected as the waste material can be received from the nozzles of the liquid ejecting head and a non-reception position where the liquid ejected as the waste material cannot be received from the nozzles, wherein the liquid container comprises a restriction portion capable of restricting the flow of the waste material to a portion of the absorber with a lower elevation, and the absorber comprises collection portions at a plurality of positions with different elevations where the waste material may be collected when the liquid container is rotated so that the bottom surface is sloped away from the horizontal plane, wherein the bottom surface of the liquid container has a nonplanar shape, and a projection portion protrudes from the inner bottom surface, the projection portion comprising the restriction portion which corresponds to the collection portions of the liquid in the absorber, wherein at least one of a projection and a step difference portion is formed on the bottom surface of the liquid container, where the projection and the step difference portion formed on the inner bottom comprise the restriction portion.

4. A liquid ejecting apparatus comprising:

a liquid ejecting head capable of ejecting liquid through a plurality of nozzles;

a liquid container capable of receiving the liquid ejected as a waste material from the plurality of nozzles of the liquid ejecting head;

an absorber disposed in the bottom of the liquid container which is capable of absorbing and storing the waste material;

a suction unit capable of sucking the waste material held by the absorber and discharging the waste material from the liquid container; and a movement mechanism which moves the liquid container between a reception position where the liquid ejected as the waste material can be received from the nozzles of the liquid ejecting head and a non-reception position where the liquid ejected as the waste material cannot be received from the nozzles, wherein the liquid container comprises a restriction portion capable of restricting the flow of the waste material to a portion of the absorber with a lower elevation, the restriction portion protruding from an inside bottom surface of the liquid container toward an opening of the liquid container and extending from a first end to a second end of the liquid container, and the absorber comprises collection portions at a plurality of positions with different elevations where the waste material may be collected when the liquid container is rotated so that the bottom surface is sloped away from the horizontal plane.

5. The liquid ejecting apparatus according to claim 4, wherein the bottom surface of the liquid container has a nonplanar shape.

6. The liquid ejecting apparatus according to claim 5, wherein a step difference portion is formed on the bottom surface of the liquid container, where the protruding restriction portion and the step difference portion formed on the inner bottom comprise the restriction portion.

7. The liquid ejecting apparatus according to claim 4, further comprising a connection channel capable of connecting the liquid container and the suction unit, wherein communication units are formed at positions in the liquid container corresponding to the collection portions of the absorber.

8. A liquid ejecting apparatus comprising:

a liquid ejecting head capable of ejecting liquid through a plurality of nozzles;

a liquid container capable of receiving the liquid ejected as a waste material from the plurality of nozzles of the liquid ejecting head;

an absorber disposed in the bottom of the liquid container which is capable of absorbing and storing the waste material;

at least one protrusion portion formed in the bottom surface of the liquid container capable of restricting the flow of the waste material due to gravity, the at least one protrusion portion extending from a first end to a second end of the liquid container;

a suction unit capable of sucking the waste material held by the absorber and discharging the waste material from the liquid container;

a connection channel formed in the liquid container capable of connecting the liquid container and the suction unit; and a movement mechanism which moves the liquid container between a reception position where the liquid ejected as the waste material can be received from the nozzles of the liquid ejecting head and a non-reception position where the liquid ejected as the waste material cannot be received from the nozzles, wherein the absorber comprises collection portions corresponding to the at least one protrusion portion located at a plurality of positions with different elevations where the waste material may be collected when the liquid container is rotated so that the bottom surface is sloped away from the horizontal plane, wherein the communication units are formed at positions in the liquid container corresponding to the collection portions of the absorber.

9. The liquid ejecting apparatus according to claim 8, wherein the at least one protrusion portion comprises a step difference portion.

* * * * *